United States Patent [19]

Gross

[11] 4,142,434

[45] Mar. 6, 1979

[54] CIRCUIT ARRANGEMENT FOR ELECTRONIC MUSICAL INSTRUMENTS

[75] Inventor: Ulrich Gross, Aachen, Fed. Rep. of Germany

[73] Assignee: U.S. Philips Corporation, New York, N.Y.

[21] Appl. No.: 596,592

[22] Filed: Jul. 17, 1975

[30] Foreign Application Priority Data

Jul. 23, 1974 [DE] Fed. Rep. of Germany ..... 2435346

[51] Int. Cl.[2] ..... G10H 1/02; G10H 5/06

[52] U.S. Cl. ..... 84/1.01; 84/1.24; 84/1.25; 84/454; 84/DIG. 10; 84/DIG. 18; 84/DIG. 20; 324/79 D

[58] Field of Search ..... 84/1.01, 1.05, 1.24, 84/1.25, 454, DIG. 2, DIG. 8, DIG. 10, DIG. 11, DIG. 18, DIG. 20; 324/78 R, 78 D, 79 R, 79 D

[56] References Cited

U.S. PATENT DOCUMENTS

| | | | |
|---|---|---|---|
| 3,164,777 | 1/1965 | Guanella | 324/79 R UX |
| 3,347,973 | 10/1967 | Freeman | 84/1.24 |
| 3,609,756 | 9/1971 | Halsall | 324/79 D X |
| 3,722,344 | 3/1973 | Nakada | 84/1.24 |
| 3,735,013 | 5/1973 | Van Der Peet et al. | 84/1.25 |

*Primary Examiner*—Stanley J. Witkowski

*Attorney, Agent, or Firm*—William J. Streeter; Simon L. Cohen

[57] ABSTRACT

In an electronic musical instrument with two tone generators of which the frequency of the tones produced by them is substantially constant for the first generator a priori and for the second generator not until after a final value is reached which corresponds to the frequency of the corresponding tone of the first generator, the frequency of the first generator is applied to a first input and that of the second generator to a second input of a frequency comparator circuit, whose output is connected to a control input of the second generator via control device. This ensures that the repeated readjustments of the control quantities necessary in known instruments are no longer necessary.

2 Claims, 7 Drawing Figures

CIRCUIT ARRANGEMENT FOR ELECTRONIC MUSICAL INSTRUMENTS

The invention relates to a circuit arrangement for an electronic musical instrument, which comprises two tone generators, the frequencies of the tones produced by them being substantially constant, for the first generator a priori and for the second generator not until after a final value is reached which corresponds to the frequency of the corresponding tone of the first generator.

Such instruments are normally provided with at least one keyboard for organ play and a separate keyboard for the so-called "synthesizer" section.

A "synthesizer" is an instrument which can only be played monophonically and by means of which nearly all quantities can be obtained which determine the sound impression by varying them continuously or in steps, as well as separately or in combination so as to imitate sounds or tones of known musical instruments or so as to produce new sounds. One of these quantities is for example the frequency, which may be constant or which in a short time interval, which may be varied, can vary from an initial value to a final value which is determined by the key which is depressed, while said frequency can also be frequency-modulated with a low frequency a priori or with a delay (so-called vibrato), etc.

The "synthesizers" are generally provided with a generator which comprises a control input, whose input via the depressed key receives a control signal, which adjusts the generator frequency to the value corresponding to the key. The control quantities should be adjusted very accurately at least with respect to their final values, in order that the "synthesizer" tones and the corresponding tones of the organ section are in unison. Otherwise the tones will be out of tune. Inevitable frequency variations within a short time interval, which may be varied, demand a repeated readjustment of said final values.

According to the invention said drawbacks are avoided, by applying the frequency of the first generator to a first input of a frequency comparator circuit and the frequency of the second generator to a second input thereof, and by connecting the output of the frequency comparator circuit via a control device to a control input of the second generator. This ensures that the final value of the frequency of the second generator automatically substantially equals the frequency of the corresponding tone of the first generator, so that separate readjustment is no longer necessary.

Of course, it is in principle also possible to provide a separate generator for each key of the "synthesizer", so as to convert the "synthesizer" into a polyphonic instrument. Compared with such an intricate design a further embodiment of the invention has the advantage that the second generator comprises a master oscillator, from the frequency of which all other tones are derived, and that the frequency comparator circuit is connected to the control input of said master oscillator.

This yields the advantage that instead of one frequency comparator circuit per tone or, in the case that twelve master oscillators with associated octave dividers are used, instead of twelve frequency comparator circuits only one frequency comparator circuit is required for all tones.

A further embodiment of the circuit arrangement for electronic musical instruments according to the invention, with a first generator, which comprises a master oscillator, from the frequency of which all desired tones are derived, is characterized in that the output of the master oscillator associated with the first generator is connected to the first input of the frequency comparator circuit and the output of the master oscillator which is associated with the second generator is connected to the second input of the frequency comparator circuit. As a result, it is possible to dispense with the switch which otherwise is necessary for each key, which switch connects the first input of the frequency comparator circuit to the output of the first generator, at which the tone which corresponds to said key is available.

It will be evident that for the oscillator or oscillators of the second generator any arbitrary controllable oscillator may be employed, but that preferably voltage-controlled oscillators are to be used.

The generators, which comprise a master oscillator, from whose frequency all other tones are derived, are known per se, for example from British Patent Specifications No. 1,099.002 and 1,264,143.

Whenever the term generator is used hereinbefore and hereinafter, this is to be understood to mean a device which provides all tones which are required in an electronic musical instrument.

For certain musical effects and/or for imitating specific instruments it is desired to additionally influence the frequency of the tones of the second generator.

For this, according to another embodiment of a circuit arrangement according to the invention, a device is included before the control device for generating a varying control quantity.

When the control quantity varies in one sense only upon depression of a key, the frequency is changed from an arbitrary initial value, which differs from the final value, to said final value. Thus, for example the sound of a steel guitar may be imitated. It will be evident that the desired effect can be adjusted by a suitable choice of the time which should elapse until the final value is reached.

In the case of a periodic variation of the control quantity at a low frequency, of for example 6 to 7 Hz, a vibrato effect is obtained. A combination of these two effects is also possible, while, if desired, said variation may also begin after a delay.

In all instruments known to date an additional keyboard or an additional row of contacts in an existing keyboard is used for the synthesizer, which owing to the resulting great technical complexity has an adverse effect on the price.

According to a further embodiment of a circuit arrangement according to the invention one of the existing keyboards also constitutes the synthesizer keyboard and means are provided for optionally disconnecting the keyboard from one of the two generators.

Yet another embodiment of the circuit arrangement according to the invention is characterized in that a multiple key detector is provided, which upon depression of several keys changes over from the second to the first generator. This ensures that during monophonic play the synthesizer sounds are played and during polyphonic play the sounds of the organ section, without the need for an additional change-over.

The invention will now be described in more detail with reference to the accompanying Figures, in which.

Figure 1:
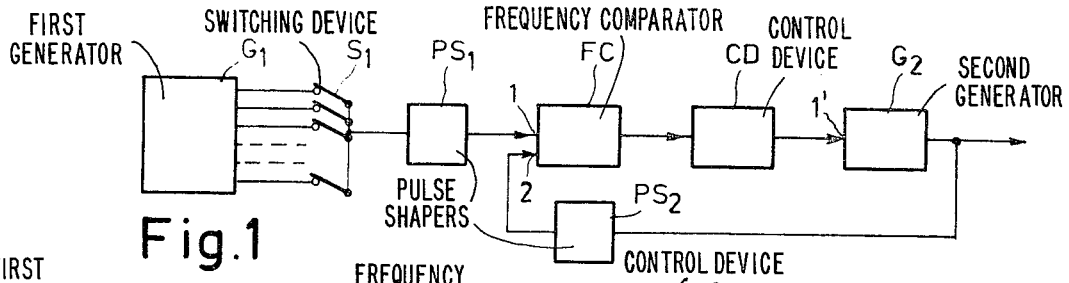
FIG. 1 shows a circuit arrangement according to the invention comprising a monophonic second generator.

In FIG. 1 the signal of a first generator $G_1$ is applied to a first input 1 of a frequency comparator circuit FC, as the case may be via a pulse shaper $PS_1$. Via a second input 2 the output signal of the second generator $G_2$, as the case may be via the pulse shaper $PS_2$ is applied to the frequency comparator circuit FC, in which after comparison of the frequencies of the two signals a signal corresponding to the frequency difference is obtained, which is applied to the control device CD, which converts the signal into a control voltage whose value depends on the frequency difference and is preferably proportional thereto. Via the control input 1' said control voltage is applied to the second generator $G_2$, which is preferably a voltage-controlled generator, so that its frequency is corrected until the frequencies of the signals at the inputs 1 and 2 of the frequency comparator circuit FC substantially correspond to each other.

For monophonic instruments only one circuit arrangement of the above mentioned type is required, a mechanical or electronical switching device $S_1$ being associated with each key of the synthesizer, which connects that output of the first generator $G_1$ at which a signal of the frequency corresponding to said key is available to the first input 1 of the frequency comparator circuit.

For a polyphonic embodiment of the synthesizer a circuit arrangement in accordance with FIG. 1 is provided for each key. Each output of the generator $G_1$ may then be continuously connected to the first input 1 of the associated frequency comparator circuit FC.

Figure 2:
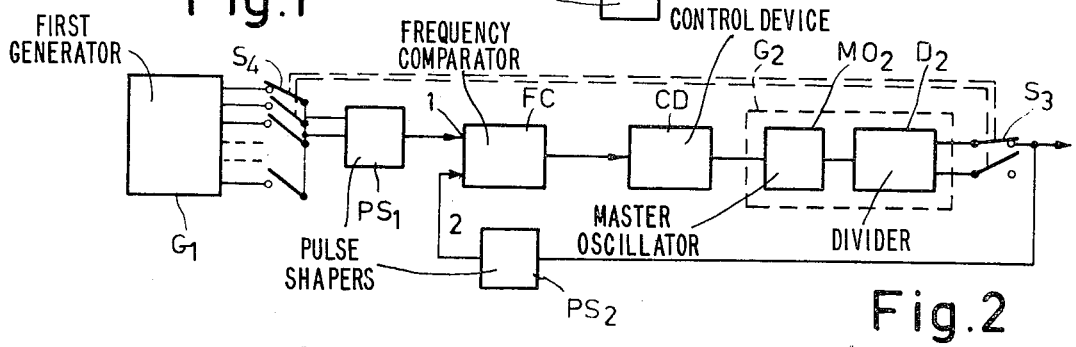
FIG. 2 shows a circuit arrangement with a polyphonic second generator.

FIG. 2 shows a circuit arrangement, which differs from the circuit arrangement of FIG. 1 in that the second generator $G_2$ of the synthesizer consists of a master oscillator $MO_2$, whose output is connected to a divider circuit $D_2$, at whose output all the desired tones are available.

Each key actuates a corresponding switch $S_3$, which connects the second input of the frequency comparator circuit FC to the associated output of the divider circuit $D_2$, and simultaneously actuates an associated switch $S_4$, which connects the appropriate output of the generator $G_1$ to the first input 1 of the frequency comparator circuit FC. The frequency of the master oscillator $MO_2$ is then readjusted to the correct value.

Said circuit arrangement also enables the synthesizer to be played polyphonically, in which case care must be taken that only a single switch $S_4$ is depressed, which can be achieved if said switches $S_4$ take the form of the priority circuit, known per se (see the German Patent Application No. 2,329,960 which has been laid open for public inspection, page 5, 1st paragraph).

Figure 3:
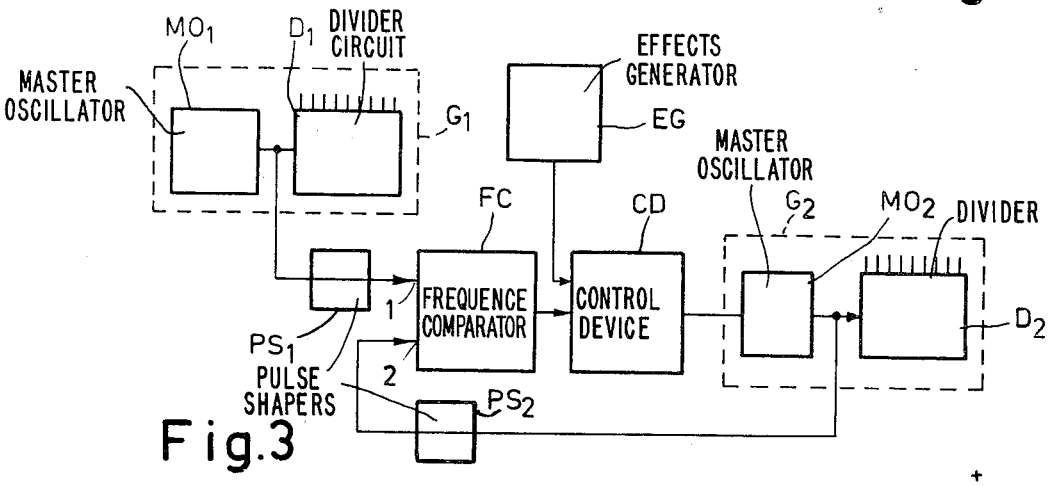
FIG. 3 shows a circuit arrangement with two polyphonic generators.

The fairly intricate groups of switches $S_3$ and $S_4$ of FIG. 2 may be dispensed with (FIG. 3) when the first generator takes the form of a master oscillator $MO_1$ to which a divider circuit $D_1$ is connected, at whose outputs all the desired tones are available.

In this case the outputs of the master oscillator $MO_1$ with a substantially constant frequency and those of the master oscillator $MO_2$ with a controllable frequency may be connected to the first input 1 or the second input 2 of the frequency comparator circuit FC.

Instead of the outputs of the master oscillators $MO_1$ and $MO_2$ it is alternatively possible to connect corresponding outputs of the divider circuits $D_1$ and $D_2$ to the inputs 1 and 2 respectively of the frequency comparator circuit FC.

An effects generator EG is connected to the control device CD to which it applies further control quantities which may be of a different kind. For example, said control quantity may vary with a low frequency, thus causing a corresponding variation of the output voltage of the control device and thus influencing the frequency of the second generator $G_2$, so that a vibrato is obtained. Furthermore, by for example correspondingly influencing a key by hand the control quantity can be varied stepwise and subsequently allowed to return slowly to its original value, so that the initial value of the frequency is lower and does not reach its final value until after a specific time, as is for example the case with a steel guitar.

It will be evident that an effects generator EG may also be included in the circuit arrangements of FIGS. 1 and 2.

Figure 4:
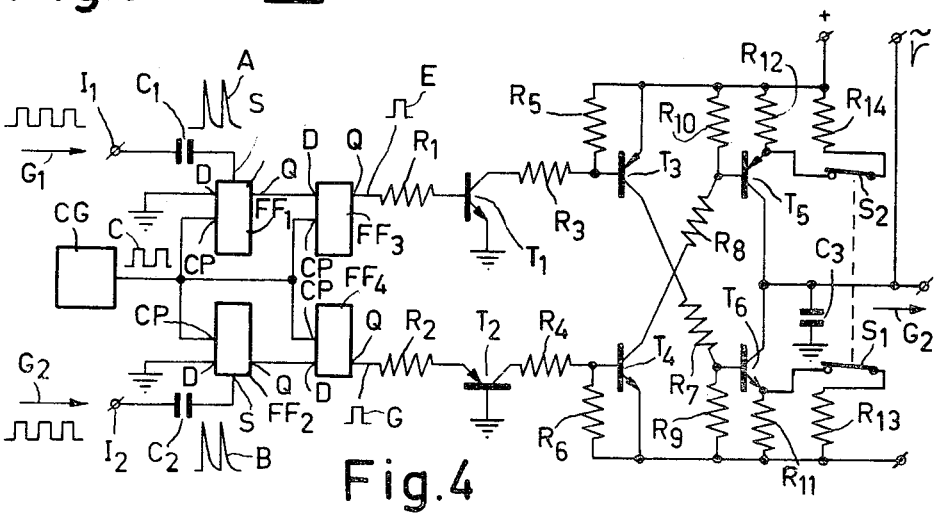
FIG. 4 shows an embodiment of a comparator circuit with a control device.
Figure 5:
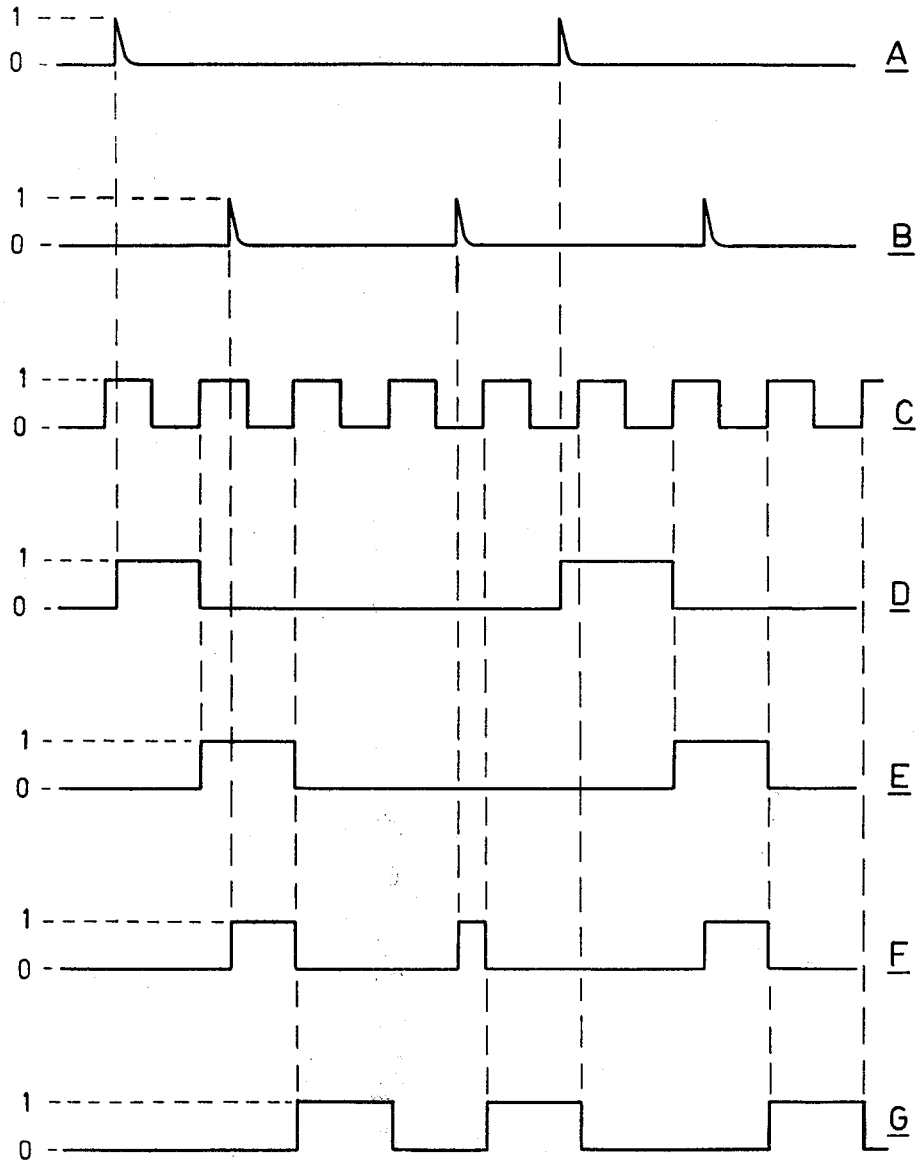
FIG. 5 shows the associated pulse trains.

FIG. 4 illustrates an example of a frequency comparator circuit with a control device coupled thereto, and FIG. 5 shows the pulse trains which appear at the various points.

The squarewave signal of substantially fixed frequency from the first generator $G_1$ is applied to the input $I_1$ and after differentiation by a capacitor $C_1$ transferred to the first input S of a first bistable multivibrator $FF_1$ as a signal A.

The squarewave signal of variable frequency from the second generator $G_2$ of the synthesizer is applied to the input $I_2$, and after differentiation by the capacitor $C_2$ it is transferred to the first input S of a second bistable multivibrator $FF_2$ as a signal B.

The two bistable multivibrators $FF_1$ and $FF_2$ change over to state 1 at the appearance of the leading edge of a differentiated pulse.

A clock pulse generator CG with a frequency above the maximum frequency of the generators $G_1$ and $G_2$ applies clock pulses C to the clock pulse inputs CP of the bistable multivibrators $FF_1$ and $FF_2$, which only respond thereto when said pulses become high at 1 and when their output Q is high, so that said output then goes to 0 again.

The outputs Q of the bistable multivibrators $FF_1$ and $FF_2$, at which the pulse trains D and E of FIG. 5 appear, are connected to an input D of the bistable multivibrator $FF_3$ and $FF_4$ respectively and in these bistables said 1-state is stored until the next clock pulse appears and the output Q of the bistable multivibrators $FF_3$ and $FF_4$ respectively is allowed to assume 1-state. When the outputs of the bistable multivibrators $FF_1$ and $FF_2$ respectively are high, they respond to the leading edge of the clock pulses and then change over to the O-state. The duration of the pulses at the output Q of the two bistable multivibrators $FF_3$ and $FF_4$, which are designated E and G in FIG. 4, consequently exactly equals one period of the clock pulses C. In order to obtain a control voltage for the second generator $G_2$ the pulses must be converted into a direct voltage. This can be effected by integrating the pulses, for example by charging a capacitor. The total charge of each pulse should then be exactly equal, in order that the charge of the capacitor be proportional to the frequency of the pulses.

Instead of the bistable multivibrators $FF_1$ and $FF_2$, it would be possible to use monostable multivibrators, when their reset times could be adjusted with sufficient accuracy and could not vary independently of each other. This is very difficult to achieve with the required accuracy.

The circuit arrangement described guarantees that the length of the pulses is constant. However, care must be taken that their amplitude meets the same requirements. For this purpose, the output pulses of the bistable multivibrators $FF_3$ are applied via a resistor $R_1$ to a (npn-type) transistor $T_1$ whose emitter is connected to ground and whose collector via a resistor $R_3$ is connected to the base of a (pnp-type) transistor $T_3$, which via a further resistor $R_5$ is connected to the positive terminal of a supply source, to which also the emitter of the transistor $T_3$ is connected. Via a resistor $R_7$ the collector of said transistor $T_3$ is connected to the base of the (npn-type) transistor $T_6$ and via a further resistor $R_9$ to the negative terminal of a supply source, to which also the emitter of the transistor $T_6$ is connected via the resistor $R_{11}$. The collector of the transistor $T_6$ is connected to the capacitor $C_3$.

When a pulse from the output Q of the bistable multivibrator $FF_3$ reaches the base of the transistor $T_1$, said transistor is turned on, so that its collector is connected to ground potential. As a result, the transistor $T_3$ is also turned on, so that the positive voltage via the resistor $R_7$ reaches the base of the transistor $T_6$ and also turns on said transistor, so that the capacitor $C_3$ is negatively charged via the resistor $R_{11}$.

The output pulses of the bistable multivibrator $FF_4$ are applied via a resistor $R_2$ to the emitter of the pnp-transistor $T_2$, whose base is connected to ground. Its collector is connected to the base of an npn-transistor $T_4$ via a resistor $R_4$ and via a resistor $R_6$ to the negative terminal of the supply source, to which also the emitter of the transistor $T_4$ is connected, whose collector via a resistor $R_8$ is connected to the base of a pnp transistor $T_5$, which via the resistor $R_{10}$ is connected to the positive terminal of the voltage source, to which the emitter of the transistor $T_5$ is also connected via a resistor $R_{12}$. The collector of the transistor $T_5$ is connected to the capacitor $C_3$.

When a pulse from the output Q of the bistable multivibrator $FF_4$ reaches the emitter of the transistor $T_2$, said transistor is turned on, so that its collector will be at zero potential and the transistor $T_4$ is also turned on. As a result, the transistor $T_5$ is also turned on via the resistor $R_8$, so that the capacitor $C_3$ is positively charged via the resistor $R_{12}$. The examples show that the frequency difference of the pulse trains at the outputs Q of the bistable multivibrators $FF_3$ and $FF_4$ determines the voltage across the capacitor.

The amplitude of the pulses with which the capacitor $C_3$ is charged, depends on the stability of the voltages from the voltage sources and on the accuracy of the resistors $R_8$, $R_{10}$, $R_{12}$ and $R_7$, $R_9$, $R_{11}$ respectively.

The voltage of the capacitor $C_3$ is supplied to the control input of the second generator $G_2$.

In the case of a monophonic instrument it is possible to obtain a slide effect, as with a trombone at the transition from one tone to another, by parallel connection of the resistor $R_{11}$ or $R_{12}$ to a resistor $R_{13}$ or $R_{14}$ respectively via a switch $S_1$ or $S_2$ respectively, which switches are coupled to each other for normal play. During normal play control of the second generator $G_2$ is then effected very rapidly, because the capacitor $C_3$ is rapidly charged or discharged. For imitating the sound of a trombone the switches $S_1$ and $S_2$ should be opened so that the charging time of the capacitor $C_3$ is longer owing to an appropriate choice of the resistors $R_{11}$ and $R_{12}$ and in the case of legato play the tones smoothly merge into each other.

When the capacitor $C_3$ is also connected to the output of the effects generator EG, the control voltage is moreover subject to the variations of this voltage.

For a vibrato effect the effects generator may consist of a low-frequency oscillator, which supplies a signal with a frequency of for example 6 to 7 Hz.

Figure 6:
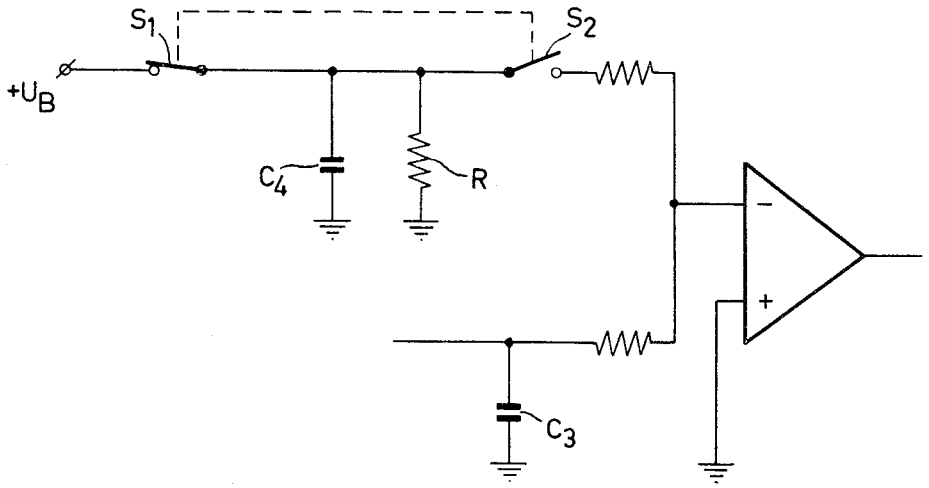
FIG. 6 shows an example of a circuit for obtaining the steel-guitar effect.

FIG. 6 shows a possible circuit arrangement for a steel-guitar effect. The capacitor $C_4$ is charged to a positive voltage $U_B$ via a normally closed switch $S_1$ and upon depression of a key the switch $S_1$ opens and the switch $S_2$ which is coupled thereto is closed, while the capacitor $C_4$ via the resistor R is gradually discharged and the capacitor voltage via resistors is added to the voltage of the capacitor $C_3$, so that initially the frequency of the second generator is lower than the final frequency value and the final value of the frequency is reached only after the desired delay.

For instruments in which only one keyboard is provided both for synthesizer sounds and organ sounds one of the two generators may at option be connected to the keyboard. When the synthesizer is monophonic, change-over may be effected automatically, so that in the case of monophonic play, i.e. when each time only one key is depressed, the synthesizer sounds are passed through and when several keys are depressed only the organ sounds.

Figure 7:
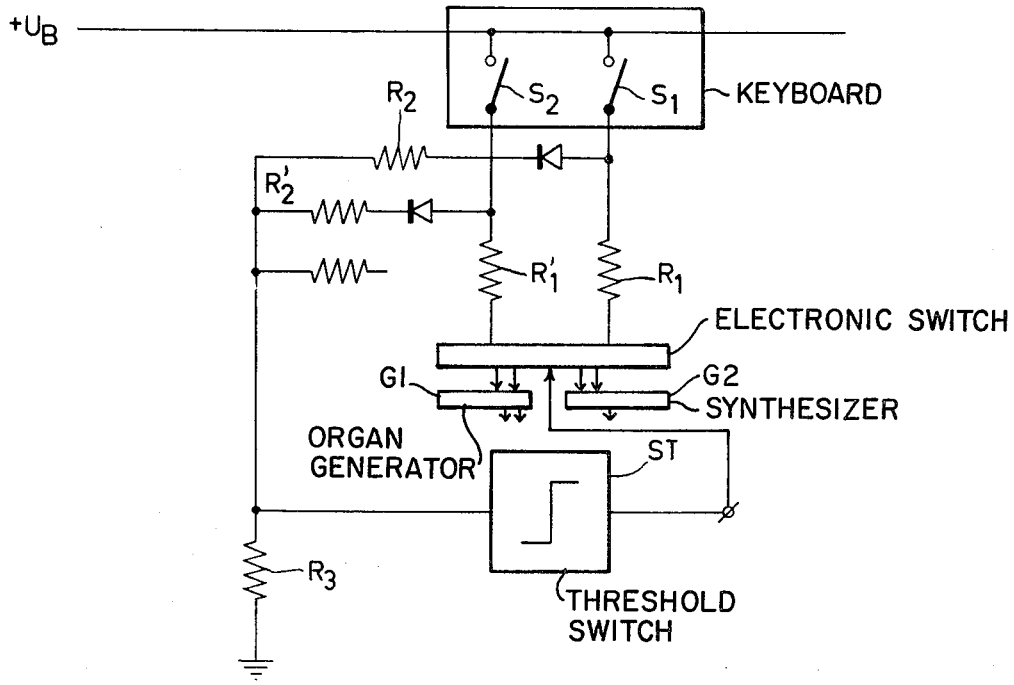
FIG. 7 shows an example of a multiple key detector.

FIG. 7 shows a possible circuit arrangement for this. The switches $S_1$, $S_2$ etc. associated with each key are connected to an electronic switch via resistors $R_1$, $R'_1$ etc. which switch transfers the desired tones from the organ generator $G_1$ in response to the operation of more than one of the keyboard switches $S_1$, $S_2$ etc.

The switches $S_1$, $S_2$ etc. are each connected to ground via a diode and resistors $R_2$, $R'_2$ etc. which are together connected to a resistor $R_3$. The connection point of the resistors $R_2$, $R'_2$ etc. and $R_3$ is connected to a threshold switch ST which opens at a specific voltage value.

So long as only one key is depressed the voltage at the input of the threshold switch ST is comparatively low and equals approximately $U_B$. $[R_3/R_2 + R_3]$ and the organ generator $G_1$ is disconnected.

As soon as a second key is depressed the voltage across $R_3$ increases, because the two resistors $R_2$ and $R'_2$ are now connected in parallel, and it becomes equal to $U_B$. $[R_3/(R_2/2) + R_3]$ . The threshold value of the threshold switch ST is then exceeded, so that it changes over, the synthesizer generator $G_2$ is disconnected and the organ generator $G_1$ is connected.

What is claimed is:

1. A circuit arrangement for an electronic musical instrument comprising a first frequency generator and a second signal-variable frequency generator, a frequency comparator, means for applying the frequency of the first generator to a first input of the frequency comparator and for applying the frequency of the second generator to a second input thereof, a control device connected to the output of the frequency comparator and to a control input of the second generator for setting the second generator to a frequency corresponding to that of the first generator, a keyboard connected to said first and second generators for selecting the frequencies thereof, and means for optionally disconnecting the keyboard from one of the two generators.

2. A circuit arrangement as claimed in claim 1, further comprising a multiple key detector means responsive to the depression of several keys by changing over frequency control by said keyboard from the second generator to the first generator.

* * * * *